US011022008B2

(12) United States Patent
VanWingerden

(10) Patent No.: US 11,022,008 B2
(45) Date of Patent: Jun. 1, 2021

(54) BALL ENGINE BRAKE MECHANISM

(71) Applicant: Eaton Intelligent Power Limited, Dublin (IE)

(72) Inventor: Mark VanWingerden, Battle Creek, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/796,121

(22) Filed: Feb. 20, 2020

(65) Prior Publication Data

US 2020/0191023 A1 Jun. 18, 2020

Related U.S. Application Data

(63) Continuation of application No. PCT/US2018/047729, filed on Aug. 23, 2018.
(Continued)

(51) Int. Cl.
*F01L 1/24* (2006.01)
*F01L 1/18* (2006.01)
(Continued)

(52) U.S. Cl.
CPC ..... *F01L 1/24* (2013.01); *F01L 1/181* (2013.01); *F01L 13/065* (2013.01); *F01L 1/26* (2013.01);
(Continued)

(58) Field of Classification Search
CPC ..... F01L 1/181; F01L 13/065; F01L 2305/00; F01L 1/24; F01L 1/26; F01L 2001/186;
(Continued)

(56) References Cited

U.S. PATENT DOCUMENTS 5,577,469 A * 11/1996 Muller ..... F01L 1/181 123/90.16
6,354,265 B1 * 3/2002 Hampton ..... F01L 1/181 123/321
2010/0170472 A1 * 7/2010 Yang ..... F01L 13/065 123/321
2010/0200358 A1 8/2010 Eisengruber et al.
(Continued)

FOREIGN PATENT DOCUMENTS

WO 2015177127 A1 11/2015
WO 2017064690 A1 4/2017

OTHER PUBLICATIONS

International Search Report and Written Opinion for International Application No. PCT/US2018/047729 dated Nov. 28, 2018.

*Primary Examiner* — Patrick Hamo
*Assistant Examiner* — Wesley G Harris
(74) *Attorney, Agent, or Firm* — RMCK Law Group PLC

(57) ABSTRACT

An exhaust valve rocker arm assembly operable in a combustion engine mode and an engine braking mode, the exhaust valve rocker arm assembly selectively opening first and second exhaust valves and including a rocker shaft, exhaust valve rocker arm assembly and a ball engine brake mechanism. The exhaust valve rocker arm assembly has an exhaust rocker arm that receives the rocker shaft and is configured to rotate around the rocker shaft. The ball engine brake mechanism is configured on the exhaust rocker arm and selectively actuates a valve plunger causing an exhaust valve to perform engine braking. The ball engine brake mechanism includes a capsule assembly having a capsule, a biasing member and a ball. The capsule has a cylindrical body that extends between a first end having an actuation face and a second end having a spring return face.

20 Claims, 6 Drawing Sheets

Related U.S. Application Data

(60) Provisional application No. 62/549,615, filed on Aug. 24, 2017.

(51) Int. Cl.

| | |
|---|---|
| ***F01L 13/06*** | (2006.01) |
| *F01L 1/26* | (2006.01) |
| *F01L 13/00* | (2006.01) |
| *F02D 13/04* | (2006.01) |
| *F02D 41/00* | (2006.01) |

(52) U.S. Cl.
CPC ..... *F01L 2001/186* (2013.01); *F01L 2013/105* (2013.01); *F01L 2305/00* (2020.05); *F02D 13/04* (2013.01); *F02D 2041/001* (2013.01)

(58) Field of Classification Search
CPC ..... F01L 2013/105; F01L 2800/06; F01L 2013/101; F01L 2013/10; F01L 13/06; F01L 1/18; F01L 1/2416; F02D 13/04; F02D 2041/001
USPC ..... 123/321, 90.16, 90.12
See application file for complete search history.

(56) References Cited

U.S. PATENT DOCUMENTS

| | | | | |
|---|---|---|---|---|
| 2012/0298057 | A1 | 11/2012 | Janak et al. | |
| 2014/0326212 | A1 | 11/2014 | Baltrucki et al. | |
| 2016/0146074 | A1* | 5/2016 | Lynch | F01L 9/04 123/90.11 |
| 2017/0016358 | A1* | 1/2017 | Yoon | F01L 1/2416 |

* cited by examiner

BALL ENGINE BRAKE MECHANISM

CROSS-REFERENCE TO RELATED APPLICATIONS

This application is a continuation of International Application No. PCT/US2018/047729 filed Aug. 23, 2019, which claims the benefit of U.S. Provisional Application No. 62/549,615 filed Aug. 24, 2017. The disclosure of the above application is incorporated herein by reference.

FIELD

The present disclosure relates generally to a rocker arm assembly for use in a valve train assembly and more particularly to a rocker arm assembly that incorporates a ball mechanism to perform an engine brake function and other variable valve actuation (VVA) functions.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An exhaust valve rocker arm assembly operable in a combustion engine mode and an engine braking mode, the exhaust valve rocker arm assembly selectively opening first and second exhaust valves and including a rocker shaft, exhaust valve rocker arm assembly and a ball engine brake mechanism. The exhaust valve rocker arm assembly has an exhaust rocker arm that receives the rocker shaft and is configured to rotate around the rocker shaft. The ball engine brake mechanism is configured on the exhaust rocker arm and selectively actuates a valve plunger causing an exhaust valve to perform engine braking. The ball engine brake mechanism includes a capsule assembly having a capsule, a biasing member and a ball. The capsule has a cylindrical body that extends between a first end having an actuation face and a second end having a spring return face. The cylindrical body defines an opening that receives the ball therein. The capsule and the ball move as a unit from an unactuated position to an actuated position.

According to additional features, the ball engine brake mechanism further comprises a threaded plunger that threadably mates with the exhaust rocker arm. The threaded plunger opposes the valve plunger. The valve plunger and the threaded plunger both define respective concave receiving surfaces. The ball positively locates at the respective concave receiving surfaces in the actuated position. The capsule and ball translates to the actuated position causing the valve plunger to extend toward one of the first and second exhaust valves to perform engine braking. The cylindrical body defines a blind bore having the spring return face.

In other features, the biasing member is at least partially nestingly received in the blind bore. The biasing member biases the capsule toward the unactuated position. A valve plunger spring biases the valve plunger to a collapsed position. A lock nut locks the threaded plunger relative to the exhaust rocker arm. The capsule assembly can be hydraulically actuated in one example. The capsule assembly can be mechanically actuated in another example. The exhaust rocker arm can be a dedicated engine brake rocker arm.

An exhaust valve rocker arm assembly according to another example of the present disclosure is operable in a combustion engine mode and an engine braking mode, the exhaust valve rocker arm assembly selectively opening first and second exhaust valves and including a rocker shaft, exhaust valve rocker arm assembly and a ball engine brake mechanism. The exhaust valve rocker arm assembly has an exhaust rocker arm that receives the rocker shaft and is configured to rotate around the rocker shaft. The ball engine brake mechanism is configured on the exhaust rocker arm and selectively actuates a valve plunger causing an exhaust valve to perform engine braking. The ball engine brake mechanism includes a capsule assembly having a capsule, a biasing member and a ball. The capsule has a unitary cylindrical body that extends between a first end having an actuation face and a second end having a spring return face. The cylindrical body defines an opening that receives the ball therein. The capsule and the ball move as a unit from an unactuated position to an actuated position. In the unactuated position, the valve plunger does not act on the exhaust valve. In the actuated position, the valve plunger acts on the exhaust valve to open the exhaust valve during an engine braking event. Translation of the actuation face causes equal translation of the spring return face.

According to additional features, the ball engine brake mechanism further comprises a threaded plunger that threadably mates with the exhaust rocker arm and that opposes the valve plunger. The valve plunger and the threaded plunger both define respective concave receiving surfaces. The ball positively locates at the respective concave receiving surfaces in the actuated position. The cylindrical body defines a blind bore having the spring return face.

In other features, the biasing member is at least partially nestingly received in the blind bore. The biasing member biases the capsule toward the unactuated position. The capsule assembly can be hydraulically actuated in one example. The capsule assembly can be mechanically actuated in another example. The capsule assembly can be electrically actuated in another example.

BRIEF DESCRIPTION OF THE DRAWINGS

The present disclosure will become more fully understood from the detailed description and the accompanying drawings, wherein.

DETAILED DESCRIPTION

Heavy duty (HD) diesel engines with single overhead cam (SOHC) valvetrain requires high braking power, in particular at low engine speed. The present disclosure provides an added motion type De-Compression engine brake. To provide high braking power without applying high load on the rest of the valvetrain (particularly the camshaft), the present disclosure provides a rocker arm assembly having a rotating stepped brake capsule with castellation mechanism for engine brake that acts on one exhaust valve. In this regard, half of the input load is experienced compared to other configurations that have two exhaust valves opening.

Figure 1:
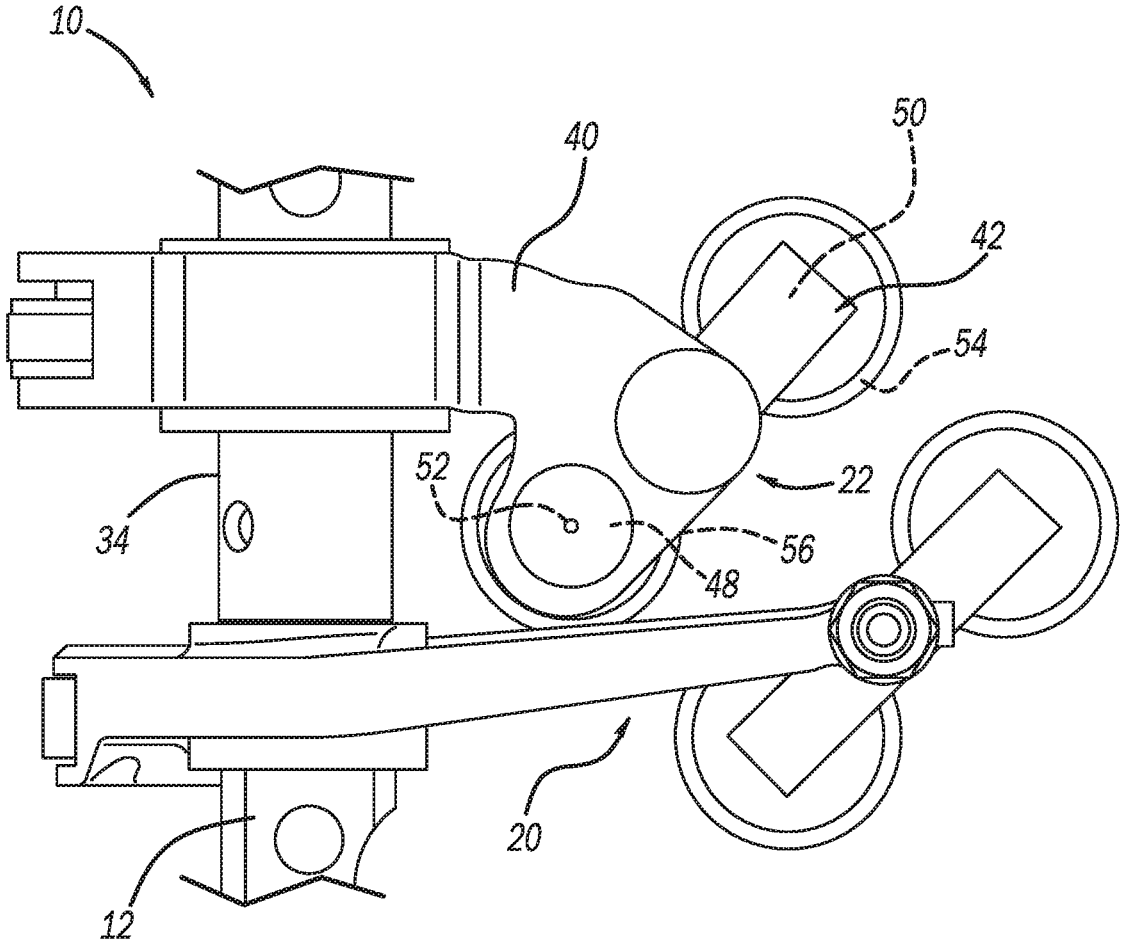
FIG. 1 is a top view of a partial valve train assembly incorporating a rocker arm assembly including ball engine brake mechanism for engine brake constructed in accordance to one example of the present disclosure.
Figure 2:
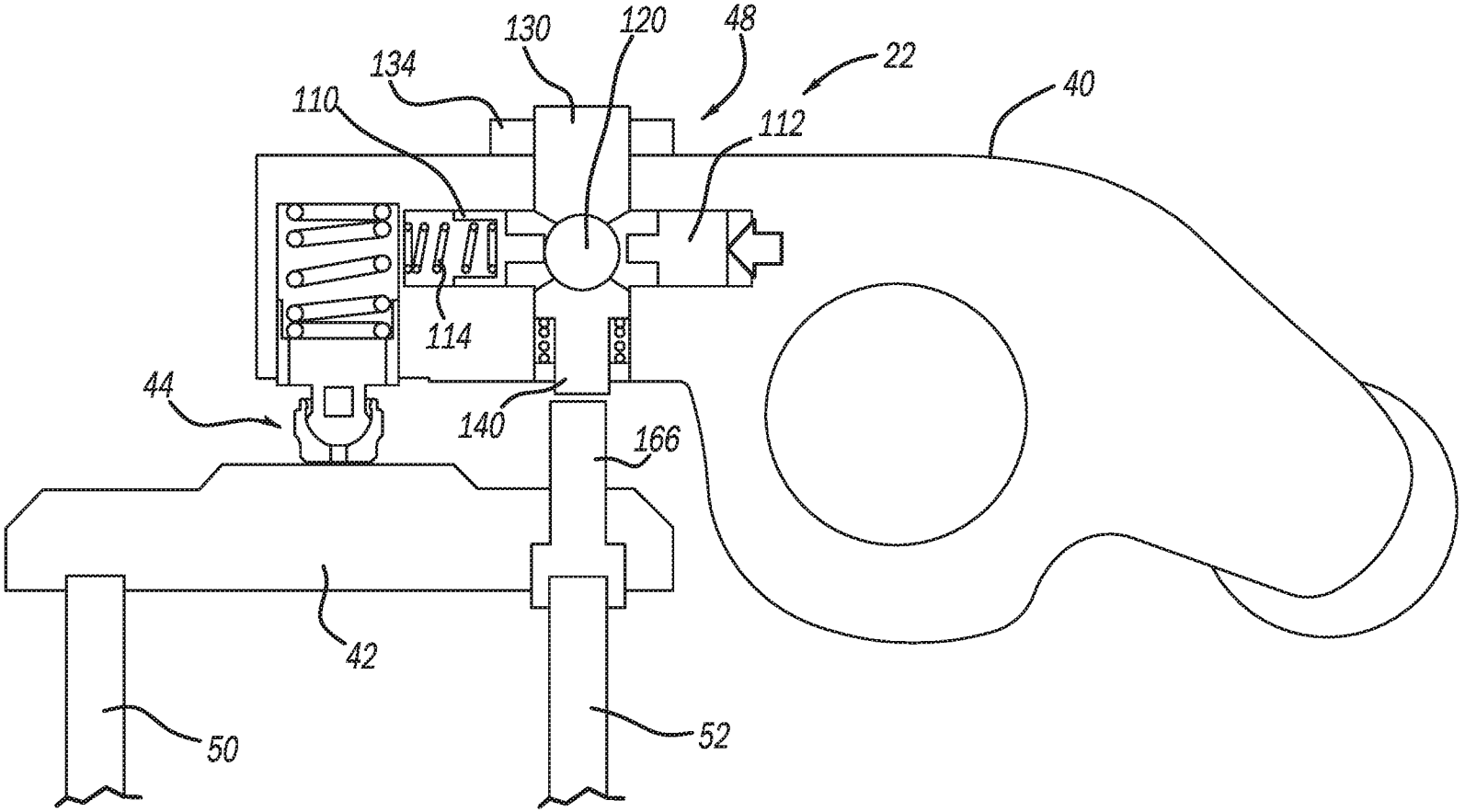
FIG. 2 is a side view of the exhaust valve rocker arm assembly of FIG. 1.

With initial reference to FIGS. 1 and 2, a partial valve train assembly constructed in accordance to one example of the present disclosure is shown and generally identified at reference 10. The partial valve train assembly 10 utilizes engine braking can be configured for use in a six-cylinder engine. It will be appreciated however that the present teachings are not so limited. In this regard, the present disclosure may be used in any valve train assembly that utilizes engine braking. The partial valve train assembly 10 is supported in a valve train carrier 12 and can include two rocker arms per cylinder. It will be appreciated that the configuration shown in FIG. 1 is merely exemplary and the valve train assembly 10 can take other arrangements within the scope of the present disclosure.

Each cylinder includes an intake valve rocker arm assembly 20, and an exhaust valve rocker arm assembly 22. The exhaust valve rocker arm assembly 22 incorporates integrated engine brake functionality. The exhaust valve rocker arm assembly 22 controls opening of the exhaust valves. The intake valve rocker arm assembly 20 is configured to control motion of the intake valves. The exhaust valve rocker arm assembly 22 is configured to control exhaust valve motion in a drive mode and in brake mode. The exhaust valve rocker arm assembly 22 is configured to act on one of the two exhaust arms in an engine brake mode as will be described herein. A rocker shaft 34 is received by the valve train carrier 12 and supports rotation of the exhaust valve rocker arm assembly 22.

With further reference now to FIG. 2, the exhaust valve rocker arm assembly 22 will be further described. The exhaust valve rocker arm assembly 22 can generally include an exhaust rocker arm 40, a valve bridge 42, a spigot assembly 44 and a ball engine brake mechanism 48. The valve bridge 42 engages a first and second exhaust valve 50 and 52 (FIG. 1) associated with a cylinder of an engine (not shown). In the example shown, the first exhaust valve 50 is a non-braking exhaust valve that is biased by a valve spring 54. The second exhaust valve 52 is a braking exhaust valve that is biased by a valve spring 56. The exhaust rocker arm 40 rotates around the rocker shaft 34 based on a lift profile of a cam shaft (explained below).

Figure 4:
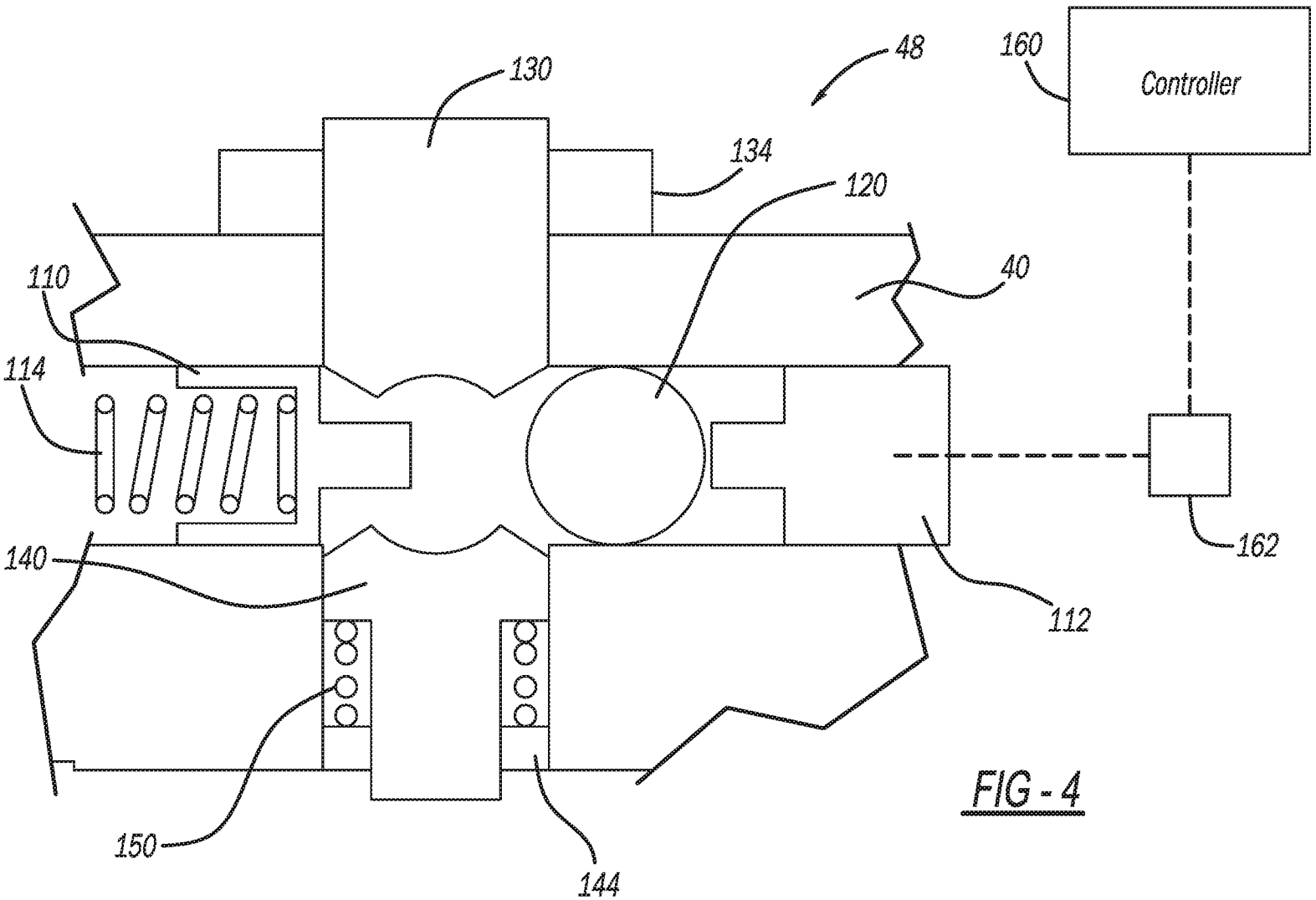
FIG. 4 is a sectional view of the ball engine brake mechanism of FIG. 1 and shown in a collapsed position subsequent to application of an actuation force.

The ball engine brake mechanism 48 will be further described. The ball engine brake mechanism 48 is capable of handling lost motion. High load can be actuated either mechanically or hydraulically and is biased to be normally collapsed (FIG. 4). The ball engine brake mechanism 48 can be used for added motion engine brake, integrated lost motion engine brake and other WA functions. In this regard, the ball engine brake mechanism 48 is configured to perform engine braking and other WA function by selectively changing a valve lift profile based on a control signal and actuation.

The ball engine brake mechanism 48 includes a press-out plunger 110 and an actuation plunger 112. A press-out biasing member 114 biases the press-out plunger 110 in a direction toward the actuation plunger 112. The press-out plunger 110 and the actuation plunger 112 are horizontally opposed. A ball 120 is positioned between the press-out plunger 110 and the actuation plunger 112. A threaded plunger 130 threadably mates with the rocker arm 40. A lock nut 134 locks the threaded plunger 130 relative to the rocker arm 40. A valve plunger 140 vertically opposes the threaded plunger 130. A valve plunger retainer 144 supports a valve plunger spring 150. The valve plunger spring 150 biases the valve plunger 140 to a collapsed position (FIG. 4).

Figure 3:
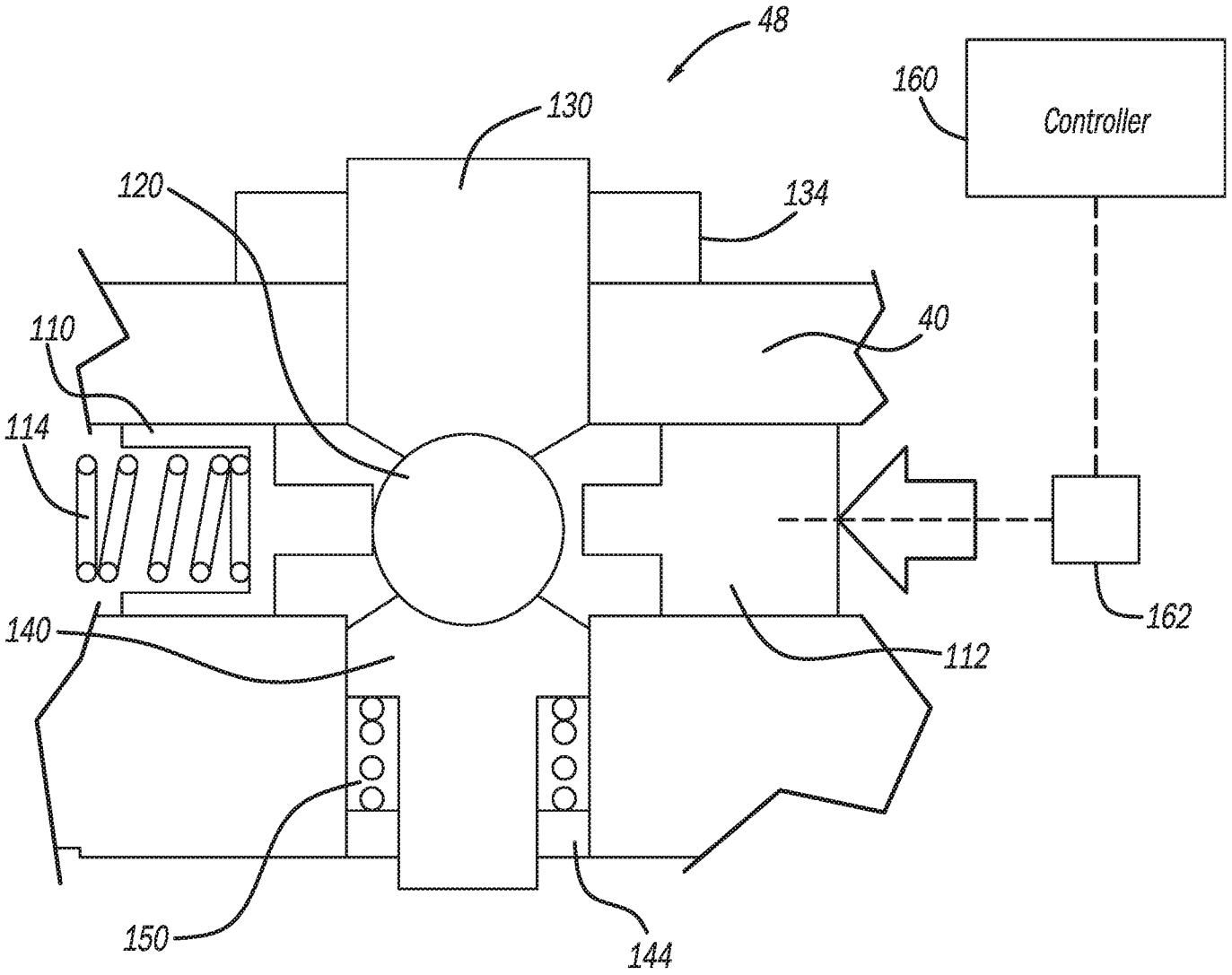
FIG. 3 is a sectional view of the ball engine brake mechanism of FIG. 1 and shown in an extended position subsequent to application of an actuation force.

The ball engine brake mechanism 48 moves between a collapsed position (FIG. 4) and an extended position (FIG. 3). The ball engine brake mechanism 48 is normally in the collapsed position. When a controller 160 determines that an engine braking event should occur, the controller 160 sends a signal to an actuator 162. The actuator 162 urges the actuation plunger 112 in a direction leftward as viewed in FIG. 3. The actuator 162 can be a hydraulic actuator, a mechanical actuator, an electric actuator or other actuator suitable to move the actuation plunger leftward causing the ball 120 to located in the position shown in FIG. 3 between the threaded plunger 130 and the valve plunger 140. Once an actuation force (hydraulic, mechanical, electrical, etc.) urges the actuation plunger 112 leftward from a position shown in FIG. 4 to a position shown in FIG. 3, the ball 120 locates between the threaded plunger 130 and the valve plunger 140 causing the valve plunger 140 to move to an extended position (FIG. 3) and act on pin 166 thereby actuating the engine valve 52 and allowing engine braking and/or other VVT functions.

When the actuation force ceases, the press-out spring 114 urges the ball 120 back to the position in FIG. 4. Concurrently, the valve plunger 140 moves back to the collapsed position by the valve plunger spring 150. The process repeats upon entering engine braking mode or other VVA function where the actuation plunger 112 is urged toward the ball 120.

Figure 5:
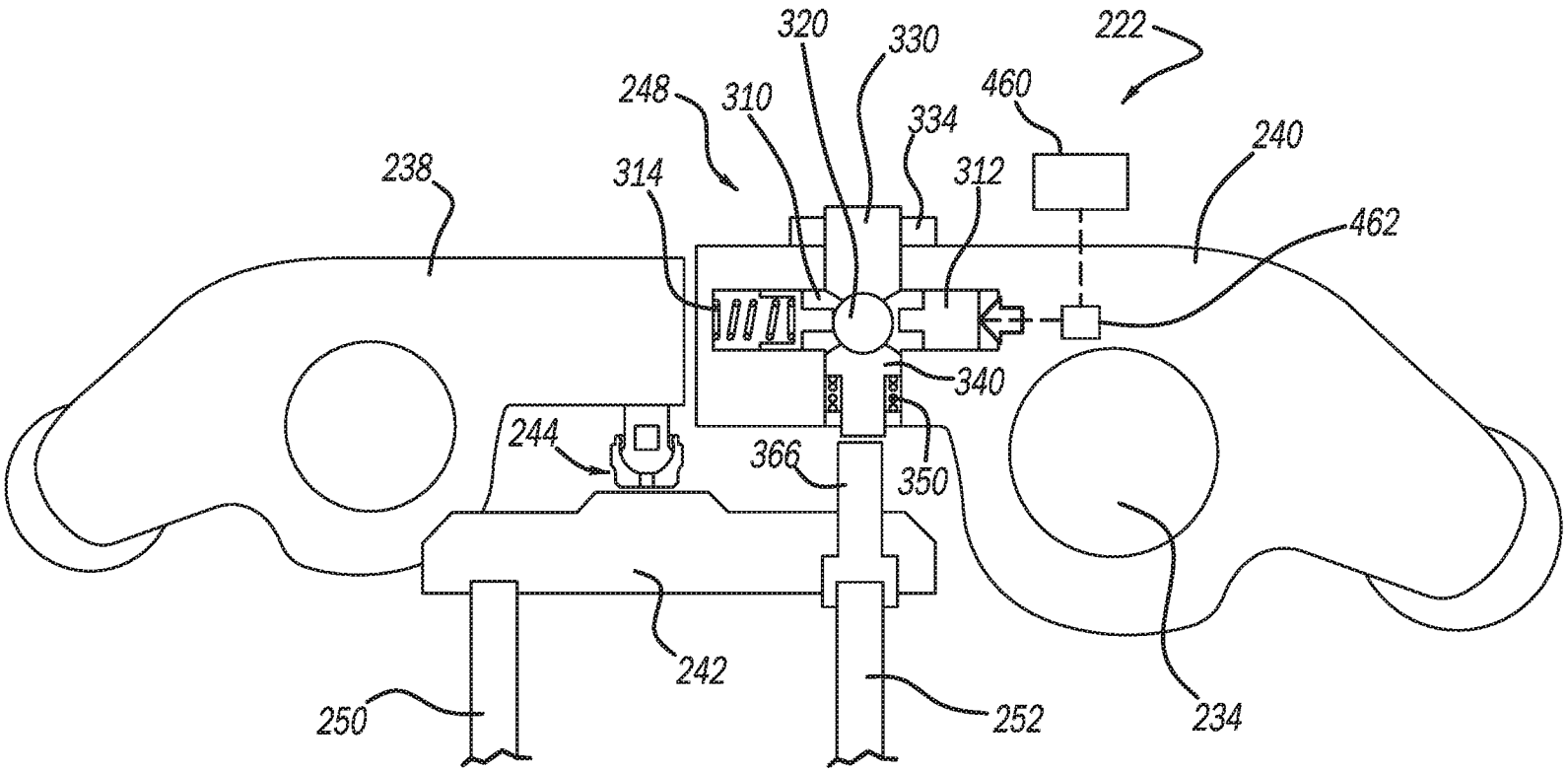
FIG. 5 is a side view of an exhaust valve rocker arm assembly having a dedicated engine brake rocker arm according to another example of the present disclosure.

With reference to FIG. 5, an exhaust valve rocker arm assembly 222 constructed in accordance to another example of the present disclosure is shown. The exhaust valve rocker arm assembly 222 includes a normal exhaust rocker arm 238 and a dedicated engine brake rocker arm 240. The exhaust valve rocker arm assembly 222 controls opening of exhaust valves 250 and 252. The intake valve rocker arm assembly can be configured similar to the intake valve rocker arm assembly 20 shown in FIG. 1. The exhaust valve rocker arm assembly 222 is configured to control exhaust valve motion in a drive mode and in brake mode. The dedicated engine brake rocker arm 240 of the exhaust valve rocker arm assembly 222 is configured to act on the exhaust valve 252 in an engine brake mode as will be described herein. A rocker shaft 234 is received by the valve train carrier and supports rotation of the dedicated engine brake rocker arm 240. The exhaust valve rocker arm assembly 222 includes a valve bridge 242, a spigot assembly 244 and a ball engine brake mechanism 248.

The ball engine brake mechanism 248 can operate similar to the ball engine brake mechanism 48 described above. The ball engine brake mechanism 248 includes a press-out plunger 310 and an actuation plunger 312. A press-out biasing member 314 biases the press-out plunger 310 in a direction toward the actuation plunger 312. The press-out plunger 310 and the actuation plunger 312 are horizontally opposed. A ball 320 is positioned between the press-out plunger 310 and the actuation plunger 312. A threaded plunger 330 threadably mates with the rocker arm 240. A lock nut 334 locks the threaded plunger 330 relative to the rocker arm 240. A valve plunger 340 vertically opposes the threaded plunger 330. A valve plunger retainer 344 supports a valve plunger spring 350. The valve plunger spring 350 biases the valve plunger 340 to a collapsed position (see position of valve plunger 140, FIG. 4).

The ball engine brake mechanism 248 moves between a collapsed position and an extended position (see ball engine brake mechanism 48, FIGS. 3 and 4). The ball engine brake mechanism 248 is normally in the collapsed position. When a controller 460 determines that an engine braking event should occur, the controller 460 sends a signal to an actuator 462. The actuator 462 urges the actuation plunger 312 in a direction leftward as viewed in FIG. 5. The actuator 462 can be a hydraulic actuator, a mechanical actuator, an electric actuator or other actuator suitable to move the actuation plunger leftward causing the ball 320 to locate in the position shown in FIG. 5 between the threaded plunger 330 and the valve plunger 340. Once an actuation force (hydraulic, mechanical, electrical, etc.) urges the actuation plunger 312 leftward to the position shown in FIG. 5, the ball 320 locates between the threaded plunger 330 and the valve plunger 340 causing the valve plunger 340 to move to an extended position (FIG. 5) and act on pin 366 thereby actuating the engine valve 252 and allowing engine braking and/or other WT functions.

When the actuation force ceases, the press-out spring 314 urges the ball 320 back to a position out of alignment with the threaded plunger 330 and the valve plunger 340. Concurrently, the valve plunger 140 moves back to the collapsed position by the valve plunger spring 150. The process repeats upon entering engine braking mode or other WA function where the actuation plunger 112 is urged toward the ball 120.

Figure 6:
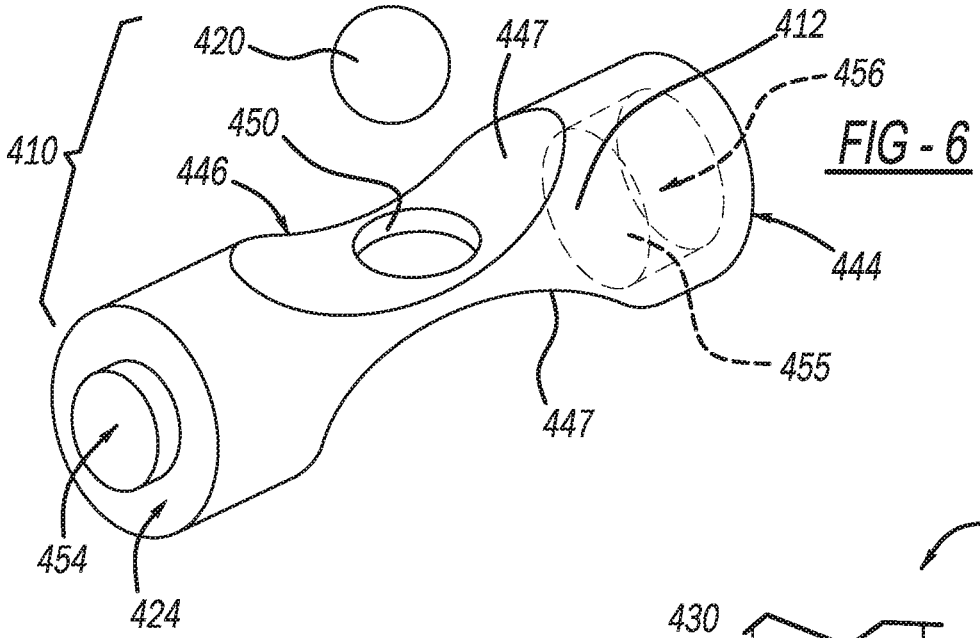
FIG. 6 is an exploded perspective view of a capsule assembly constructed in accordance to one example of the present disclosure.
Figure 7:
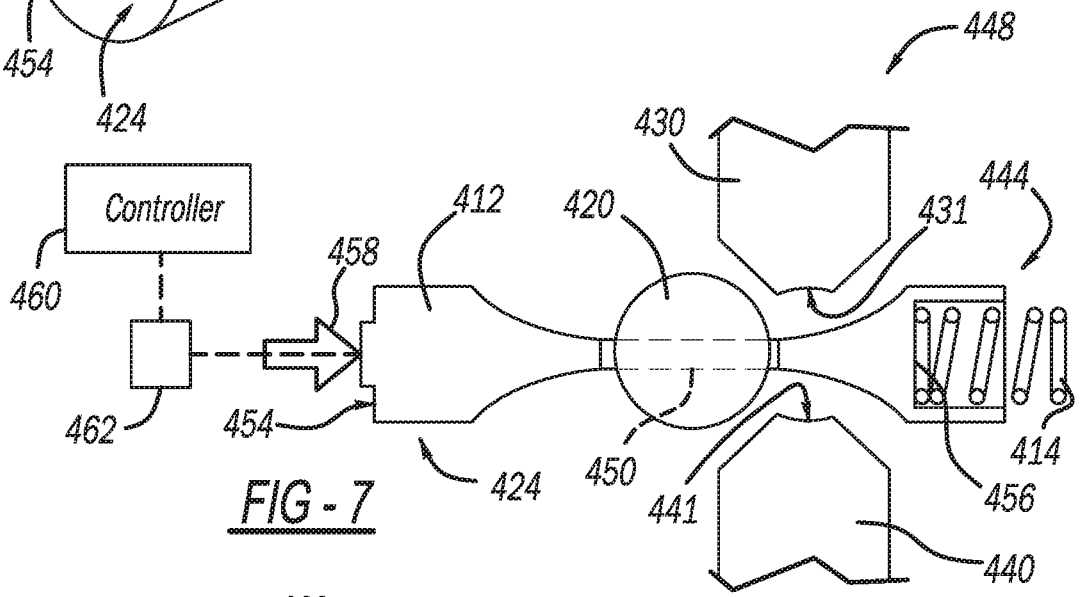
FIG. 7 is a sectional view of the capsule assembly of FIG. 6 and shown disposed between a threaded plunger and valve plunger in an actuated position according to one example of the present disclosure.
Figure 8:
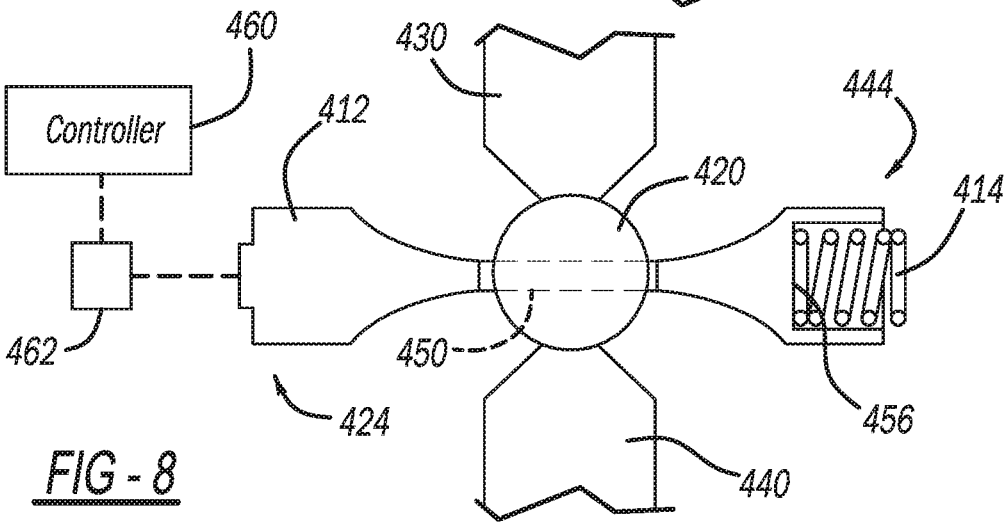
FIG. 8 is a sectional view of the capsule assembly of FIG. 7 and shown offset from the threaded plunger and valve plunger in an unactuated position according to one example of the present disclosure.

With reference now to FIGS. 6-8, a capsule assembly 410 constructed in accordance to another example of the present disclosure will be described. It will be appreciated that that the capsule assembly 410 can be used in any of the rocker arm configurations described herein. The capsule assembly 410 generally comprises a capsule 412, a biasing member 414 and a ball 420. A threaded plunger 430 threadably mates with the rocker arm as discussed above. The threaded plunger 430 can define a concave receiving surface 431 on a distal end thereof. A valve plunger 440 vertically opposes the threaded plunger 430. The valve plunger 440 can define a concave receiving surface 441 on a distal end thereof. A ball engine brake mechanism 448 comprises the capsule assembly 410, the threaded plunger 430 and the valve plunger 440.

As will become appreciated from the following discussion, the capsule assembly 410 can translate as a single unit between an unactuated position shown in FIG. 7 and an actuated position (such as for engine braking) shown in FIG. 8. The capsule 412 can include a cylindrical body 422 extending between a first end 424 and a second end 444. A central body portion 446 defines inset portions 447. An opening 450 is defined through the cylindrical body 422 at the central body portion 446. The opening 450 defines an inner diameter suitable to accept the ball 420 therein.

The first end 424 defines an actuation face 454. The cylindrical body 422 defines a blind bore 455 having a spring return face 456 at the second end 444. The biasing member 414 is at least partially nestingly received in the blind bore 455. An actuation force 458 generated by actuator 462 (hydraulic, mechanical, electrical) in response to a signal from the controller 460 is applied onto the actuation face 454. The biasing member 414 acts on the spring return face 456.

The actuation force 458 is directly linked to the spring return face 456. In other words, the capsule 412 is unitary or integrally formed whereby the force 458 acting onto the actuation face 454 is directly connected and acted onto the spring return face 456. In this regard, separation of the actuation face 454 and the spring return face 456 is precluded. Translation of the actuation face 454 causes equal translation of the spring return face 456. Greater control of the position of the ball 420 is realized by the capsule assembly 410 and the ball engine brake mechanism 448 as a whole. The ball 420 positively locates between the concave receiving surface 431 of the threaded plunger 430 and the concave receiving surface 441 of the valve plunger 440. By way of example, the capsule 412 can be about 11.5 mm in diameter. The opening 450 can be 9.5 mm in diameter. The ball 420 can be 9 mm in diameter. Other dimensions are contemplated.

It will be further appreciated that any of the ball brake mechanisms described herein may be used in a dedicated added motion engine brake arm and/or a bolt on bleeder brake design. In this regard, the ball brake mechanism is mounted in a dedicated brake arm that acts on the brake valve through a pass through pin or similar arrangement. Similarly, the ball brake mechanism can be used in a bolt on carrier fixed to the cylinder head where the mechanism could act on the brake valve through a pass through pin or similar arrangement.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An exhaust valve rocker arm assembly operable in a combustion engine mode and an engine braking mode, the exhaust valve rocker arm assembly selectively opening first and second exhaust valves and comprising:

a rocker shaft;

an exhaust valve rocker arm assembly having an exhaust rocker arm that receives the rocker shaft and is configured to rotate around the rocker shaft; and a ball engine brake mechanism configured on the exhaust rocker arm and that selectively actuates a valve plunger causing an exhaust valve to perform engine braking, the ball engine brake mechanism comprising:

a capsule assembly having a capsule, a biasing member and a ball, the capsule having a cylindrical body extending between a first end having an actuation face and a second end having a spring return face, the cylindrical body defining an opening that receives the ball therein, wherein the capsule and ball move as a unit from an unactuated position to an actuated position; and a threaded plunger that threadably mates with the exhaust rocker arm, wherein the valve plunger and the threaded plunger both define respective concave receiving surfaces, wherein the ball positively locates at the respective concave receiving surfaces in the actuated position.

2. The exhaust valve rocker arm assembly of claim 1 wherein the threaded plunger opposes the valve plunger.

3. The exhaust valve rocker arm assembly of claim 2, further comprising a lock nut that locks the threaded plunger relative to the exhaust rocker arm.

4. The exhaust valve rocker arm assembly of claim 1 wherein the capsule and ball translates to the actuated position causing the valve plunger to extend toward one of the first and second exhaust valves to perform engine braking.

5. The exhaust valve rocker arm assembly of claim 4, further comprising a valve plunger spring that biases the valve plunger to a collapsed position.

6. The exhaust valve rocker arm assembly of claim 1, wherein the cylindrical body defines a blind bore having the spring return face.

7. The exhaust valve rocker arm assembly of claim 6 wherein the biasing member is at least partially nestingly received in the blind bore.

8. The exhaust valve rocker arm assembly of claim 7, wherein the biasing member biases the capsule toward the unactuated position.

9. The exhaust valve rocker arm assembly of claim 1 wherein the capsule assembly is actuated hydraulically.

10. The exhaust valve rocker arm assembly of claim 1 wherein the capsule assembly is actuated mechanically.

11. The exhaust valve rocker arm assembly of claim 1 wherein the exhaust rocker arm is a dedicated engine brake rocker arm.

12. An exhaust valve rocker arm assembly operable in a combustion engine mode and an engine braking mode, the exhaust valve rocker arm assembly selectively opening first and second exhaust valves and comprising:

a rocker shaft;

an exhaust valve rocker arm assembly having an exhaust rocker arm that receives the rocker shaft and is configured to rotate around the rocker shaft; and a ball engine brake mechanism configured on the exhaust rocker arm and that selectively actuates a valve plunger causing an exhaust valve to perform engine braking, the ball engine brake mechanism comprising:

a capsule assembly having a capsule, a biasing member and a ball, the capsule having a unitary cylindrical body extending between a first end having an actuation face and a second end having a spring return face, the cylindrical body defining an opening that receives the ball therein, wherein the capsule and ball move as a unit from an unactuated position wherein the valve plunger does not act on the exhaust valve to an actuated position wherein the valve plunger acts on the exhaust valve to open the exhaust valve during an engine braking event, wherein translation of the actuation face causes equal translation of the spring return face; and a threaded plunger that threadably mates with the exhaust rocker arm, wherein the valve plunger and the threaded plunger both define respective concave receiving surfaces, wherein the ball positively locates at the respective concave receiving surfaces in the actuated position.

13. The exhaust valve rocker arm assembly of claim 12, wherein the cylindrical body defines a blind bore having the spring return face.

14. The exhaust valve rocker arm assembly of claim 13 wherein the biasing member is at least partially nestingly received in the blind bore.

15. The exhaust valve rocker arm assembly of claim 14, wherein the biasing member biases the capsule toward the unactuated position.

16. The exhaust valve rocker arm assembly of claim 12 wherein the capsule assembly is actuated one of hydraulically, mechanically and electrically.

17. An exhaust valve rocker arm assembly operable in a combustion engine mode and an engine braking mode, the exhaust valve rocker arm assembly selectively opening first and second exhaust valves and comprising:

a rocker shaft;

an exhaust valve rocker arm assembly having an exhaust rocker arm that receives the rocker shaft and is configured to rotate around the rocker shaft;

a ball engine brake mechanism configured on the exhaust rocker arm and that selectively actuates a valve plunger causing an exhaust valve to perform engine braking, the ball engine brake mechanism comprising:

a capsule assembly having a capsule, a biasing member and a ball, the capsule having a cylindrical body extending between a first end having an actuation face and a second end having a spring return face, the cylindrical body defining an opening that receives the ball therein, wherein the capsule and ball move as a unit from an unactuated position to an actuated position, wherein the capsule and ball translates to the actuated position causing the valve plunger to extend toward one of the first and second exhaust valves to perform engine braking; and a valve plunger spring that biases the valve plunger to a collapsed position.

18. The exhaust valve rocker arm assembly of claim 17 wherein the capsule and ball translates to the actuated position causing the valve plunger to extend toward one of the first and second exhaust valves to perform engine braking.

19. The exhaust valve rocker arm assembly of claim 17 wherein the ball engine brake mechanism further comprises:

a threaded plunger that threadably mates with the exhaust rocker arm.

20. The exhaust valve rocker arm assembly of claim 17 wherein the capsule assembly is actuated one of hydraulically and mechanically.

* * * * *